US005494561A

United States Patent [19]

Darche et al.

[11] Patent Number: 5,494,561

[45] Date of Patent: Feb. 27, 1996

[54] APPARATUS FOR SURFACE TREATMENT BY CATAPHORESIS OF METAL PARTS, PARTICULARLY OF MOTOR VEHICLE BODIES

[75] Inventors: Christian Darche, Maulette; Daniel Auffret, Plaisir, both of France

[73] Assignee: Societe Anonyme Dite Regie Nationale des Usines Renault, Boulogne Billancourt, France

[21] Appl. No.: 327,632

[22] Filed: Oct. 24, 1994

[30] Foreign Application Priority Data

Oct. 22, 1993 [FR] France ..... 93 12610
Oct. 22, 1993 [FR] France ..... 93 12611

[51] Int. Cl.[6] ..... B65G 49/00
[52] U.S. Cl. ..... 204/625
[58] Field of Search ..... 204/300 EC, 299 EC

[56] References Cited

U.S. PATENT DOCUMENTS 4,959,137 9/1990 Matsuoka et al. ..... 204/300 EC

*Primary Examiner*—John Niebling
*Assistant Examiner*—Kishor Mayekar
*Attorney, Agent, or Firm*—Oblon, Spivak, McClelland, Maier & Neustadt

[57] ABSTRACT

Apparatus for surface treatment by cataphoresis of metal parts (5) particularly of motor vehicle bodies, supplied by direct current. A tank (1) whose sides carry anodes (2) is provided where the treatment occurs. An overhead conveyor is provided which brings the bodies (5) to be treated in swingtrays spaced apart by a regular spacing λ. A carriage or main body (4) equipped with two contact slides (41, 42) mounted on two parallel conductive rails (11, 12) and located above the tank (1), provide electrical connection to each body. The bodies (5) to be treated effectively becoming the cathodes. The two rails (11, 12) are divided regularly into portions or dividing rails (111, 121) by an insulating material, each portion connected to the negative terminals (31) of rectifiers (3), supplying the current. Each mobile body (4) is always in electrical contact with a divided rail (111, 121) to ensure that no unnecessary cut offs of current occur, thereby preventing coating defects.

17 Claims, 2 Drawing Sheets

APPARATUS FOR SURFACE TREATMENT BY CATAPHORESIS OF METAL PARTS, PARTICULARLY OF MOTOR VEHICLE BODIES

BACKGROUND OF THE INVENTION

1. Field of the Invention

The present invention relates to an apparatus for surface treatment of metal parts by cataphoresis, and, more particularly, to surface treatment of motor vehicle bodies by cataphoresis.

2. Description of the Related Art

Treatment of surfaces by cataphoresis is accomplished by transporting the bodies through a treatment vessel along two parallel rails. The two parallel rails supply current to each of the bodies to be treated and are divided into portions, called dividing zones, separated by an insulating material, each rail portion supplying current from a different current source. However, the conventional treatment device results in coating defects because each body to be treated encounters several periods where current is cut off. During the passage of the bodies along the insulating material, the corresponding current source is cut off. With the conventional device, the current to each body is switched on and off, creating erratic current surges and causing coating defects.

Furthermore, the conventional device is disadvantageous because the actual dip time of the body part in the vessel becomes shorter due to the periods when the current is cut off. Thus, the treatment devices of the related art must be lengthened to obtain the dip time necessary for the treatment of the part. Otherwise, the rate of speed of the treatment process must be slowed. In either case, the conventional device produces defective coatings and is inefficient.

SUMMARY OF THE INVENTION

The present invention has as its object to make it possible to perform a treatment of surfaces on metal parts by customizing the treatment for each of the parts without the latter undergoing a current cutoff to control the problems of appearance of the treated parts.

The present invention also has as its object an apparatus for treatment of surfaces by cataphoresis that can be adapted to any rate of speed without necessity of lengthening the apparatus.

The present invention further has as its object to make possible a control of the voltage and current received at each moment by the parts to be treated and a precise knowledge of the voltage and current values.

The present invention treats surfaces of bodies by cataphoresis, and achieves the above objectives with the following described apparatus. A tank is provided where the treatment occurs and carries anodes for carrying out cataphoresis. An overhead conveyor transports the bodies to be treated through the tank at regular spaced intervals of a length λ. Mobile bodies or carriages, constituting a first current supply means, are moved by the conveyor and are electrically connected to a corresponding body, effectively making the bodies into cathodes. A pair of rails are provided, each including a plurality of divided rails separated by electrically insulated material, constitute a second current supply means. Each of the mobile bodies are always in direct slidable contact with any of the divided rails.

In a first embodiment, the insulated material between each divided rail has a length larger than a surface of the mobile bodies which contacts the rails. However, each mobile body always electrically contacts a divided rail because the divided rails are offset with respect to each other.

In a second embodiment, the divided rails are not offset from one another, but the mobile portions still always electrically contact a divided rail because the length of the electrically insulated material between each divided rail is smaller than a length of a surface of the mobile portion which contacts the rails.

Other objects, features, and advantages of the present invention will become apparent from the following detailed description. It should be understood, however, that various changes and modifications within the spirit and scope of the invention will become apparent to those skilled in the art from this detailed description.

BRIEF DESCRIPTION OF THE DRAWINGS

A more complete appreciation of the present invention and many of its attendant advantages will be readily obtained by reference to the following detailed description considered with the accompanying drawings, in which.

DETAILED DESCRIPTION OF THE PREFERRED EMBODIMENTS

Figure 1:
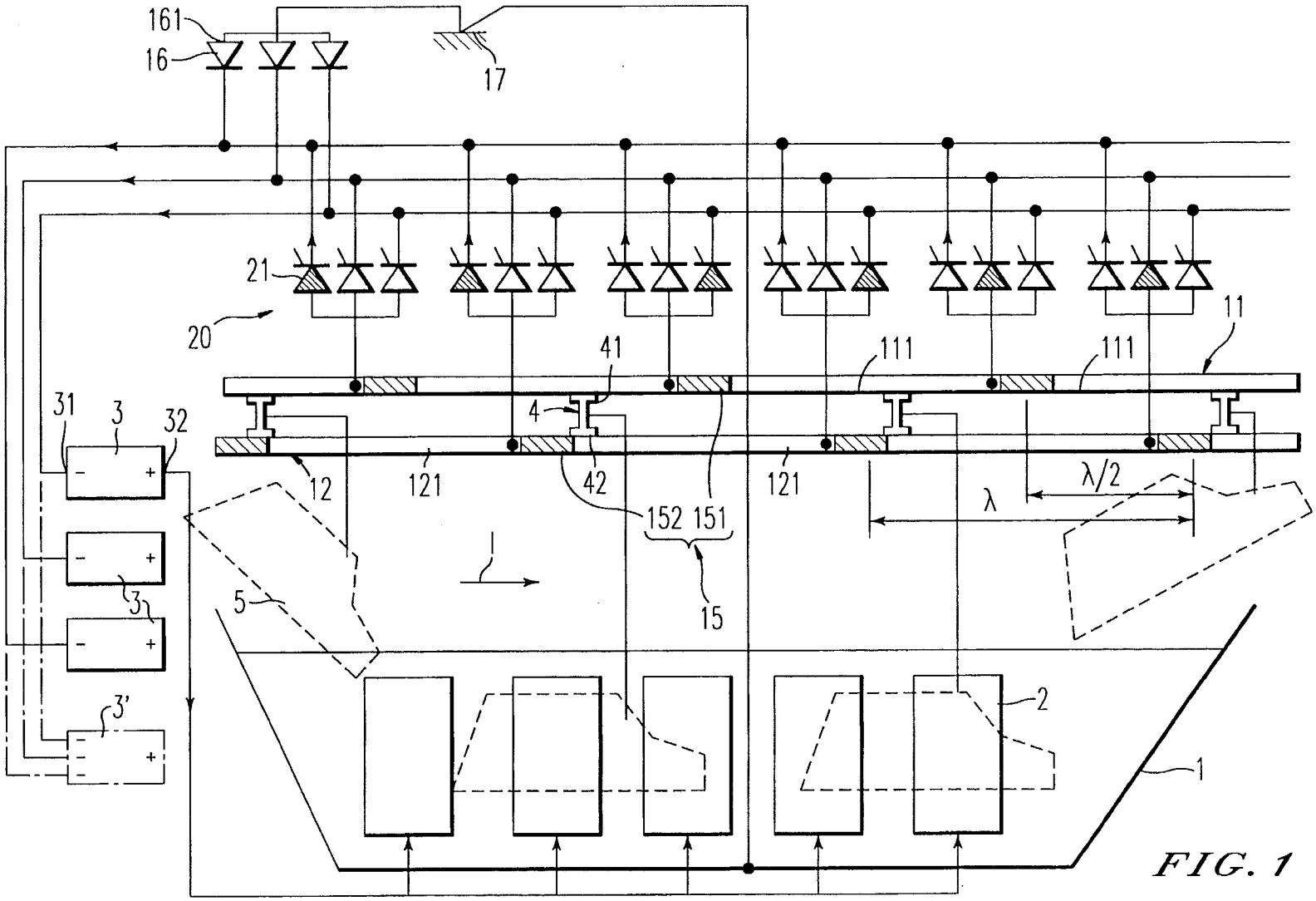
FIG. 1 is a partial diagrammatic representation of the apparatus of the first embodiment.

Referring now to the drawings, wherein like reference numerals designate identical or corresponding parts throughout the several views, the first embodiment of the present invention will be described with reference to FIGS. 1 and 2.

According to FIG. 1, the first embodiment of the present invention includes a painting tank 1 whose sides carry anodes 2 connected to positive terminals 32 of rectifiers 3 to supply direct current to the apparatus.

The apparatus also has an overhead conveyor, not shown, which brings bodies 5 or metal parts to be treated in swingtrays spaced apart by a regular spacing λ. Each body having a corresponding carriage 4 equipped with two contact slides 41 and 42 mounted on two parallel conductive rails 11 and 12 located above tank 1. These rails 11 and 12 are divided regularly into divided rails or portions 111 and 121, respectively, separated by an insulating material and connected to negative terminals 31 of rectifiers 3, so that bodies 5 constitute the cathodes for the cataphoresis process.

The dividing zones thus obtained made by the insulating material, 151 and 152 respectively, are spaced apart on each of rails 11, 12 by spacing λ. Dividing zones 151 are offset linearly in relation to dividing zones 152, this linear offsetting being equal to λ/2.

The number of rectifiers 3 used is preferably equal to the number of bodies 5 simultaneously present in tank 1. However, it is possible to provide a reserve rectifier 3' as represented in FIG. 1. Negative terminals 31 of these rectifiers 3 are connected respectively to diodes 16 whose anodes 161 are connected to ground 17 of tank 1 so that the diode connected to the rectifier with the strongest potential becomes conductive, thus avoiding problems of corrosion.

The supplying of current for each portion 111, 121 of rails 11 and 12 is achieved by a group 20 of thyristors 21 each of which is connected by its cathode to the negative terminal of a different rectifier 3 so that it is possible to select, thanks to these thyristors 21, any of rectifiers 3 to supply a divided rail.

The dividing zones 151 and 152 have a length greater than that of a slide 41, 42 to cause the thyristors to completely switch off, (the thyristors located on the rail concerned when the carriages are located on said dividing zones of this rail). However, the dividing zones 151 and 152 have a length less than $\lambda/4$ for the purpose, when passing dividing zones 151 or 152, of changing the switching of thyristors 21 of each group 20 connected to the rail concerned, while thus determining the conductive thyristor of each group 20 before the carriage enters into a new portion.

Thyristors 21 of a same group 20 are grouped together and located near rails 11 and 12 to minimize the sparking that is produced during the switching off of the thyristors by entry of carriages 4 in dividing zones 151 and 152. Actually, this sparking is due to the energy stored in the portion of wire containing the thyristor which was in operation and is therefore proportional to the inductance of the wire where the current, itself a function of the length of the latter, was circulating.

An example of the first embodiment in operation will now be described. Arrow I represents the direction of circulation of bodies 5 through tank 1. The two portions 111, 121 are in contact with slides 41, 42 of the same carriage 4 and are supplied power by the same rectifier 3. Thyristors 21 continuously receive pulses to be started (actually this arrangement makes it possible, during a possible false contact between a slide 41, 42 and a rail portion 111, 121 or in the circuit switching off the thyristor concerned, that the latter is immediately restarted). During the passage of carriages 4 past dividing zones 151 of one of rails 11, 12, all thyristors 21 connected to the rail 11 are switched off and do not receive pulses. Slides 42 in connection with portions 121 are still supplied, each of them being connected, by groups 20 connected to rail 12, to a rectifier 3. During this switching off period, an automatic or manual control makes it possible to select thyristors 21 of groups 20 of rail 11 so that slides 41 in contact with portions 111 coming from dividing zones 151 are supplied by the same rectifier as slides 42. Then, thyristors 21 are restarted when carriages 4 leave dividing zones 151. The same is true for slides 42 in dividing zones 152 of rail 12.

Thus, everything happens as if each rectifier 3 were connected to a particular body 5 and accompanies it during its movement in tank 1 and coating defects are prevented.

Figure 2:
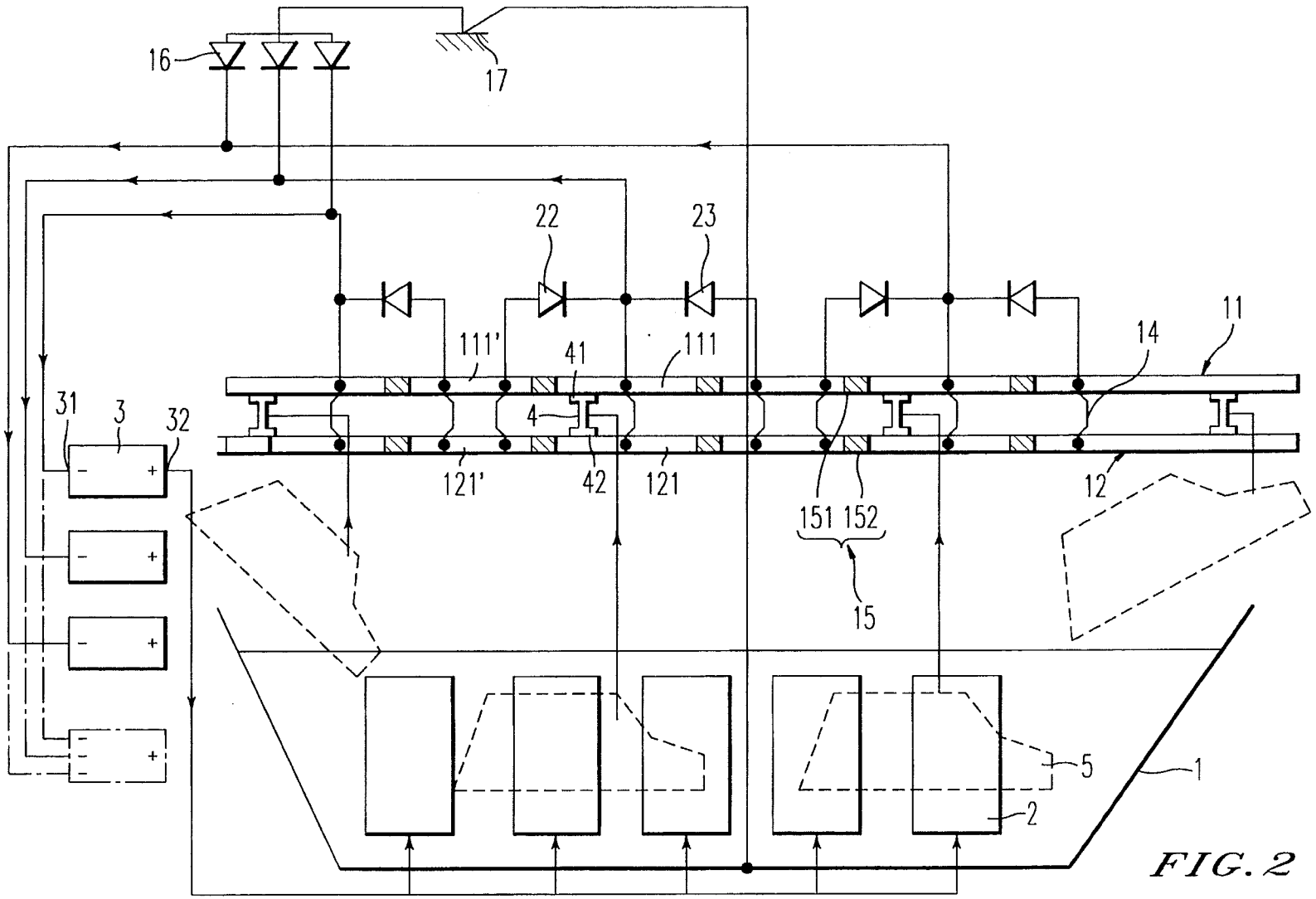
FIG. 2 is a partial diagrammatic representation of the apparatus of the second embodiment.

According to FIG. 2, the second embodiment of the present invention includes a painting tank 1 whose sides carry anodes 2 connected to positive terminals 32 of rectifiers 3 supplying direct current to the apparatus. The apparatus also has an overhead conveyor, not shown, which brings bodies 5 to be treated spaced apart by a regular spacing $\lambda$ and which carries first current supply means consisting of mobile bodies in contact with a second current supply means mounted on at least one support, not shown, located above tank 1.

The mobile bodies are preferably carriages 4 equipped with at least one contact slide 41 mounted on the second current supply means (i.e., a rail 11) and carried by swing-trays which support bodies 5. However, the mobile bodies may also be a shuttle in contact with a series of stationary slides which constitute the second supply means, the portions of said conducting means then corresponding to a group of stationary slides.

The second embodiment of an apparatus according to the invention will be described by way of example, whose first current supply means includes of carriages and which have two conductive rails 11 and 12. These rails 11 and 12 are divided regularly at an interval approximately equal to $\lambda/2$ in portions or divided rails 111 and 121, respectively, separated by an insulating material. The divided rails are connected to negative terminals 31 of rectifiers 3 of the current supplying the apparatus. The dividing zones 15 thus obtained by the insulating material, 151 and 152 respectively, for rails 11 and 12, are opposite each other and have a length less than that of slides 41 and 42 to prevent an interruption of the supply to bodies 5.

The number of rectifiers 3 used is preferably equal to the number of bodies 5 simultaneously present in tank 1, but may be of a different number. These rectifiers 3 are connected respectively to diodes 16 whose anodes 161 are connected to ground 17 of tank 1 so that a diode connected to the rectifier with the strongest potential becomes conductive thus avoiding problems of corrosion.

Portions 111 and 121 are supplied directly by a rectifier 13 and other portions 111' and 121' of rails 11 and 12 are supplied by two thyristors 22 and 23 in opposition, each of them being connected to a different rectifier 3 so that two juxtaposed portions 111, 111' or 121, 121' have different source of power.

Thyristors 22, 23 of each portion 111', 121' are located adjacent their corresponding portions. For example, thyristors 22 and 23 of two portions 111' adjacent to the same portion 111 are supplied power directly by a rectifier 3 and are located nearby.

Supply wires produce bridgings 14 between the two rails 11 and 12, connecting the divided rails 111, 111', 121 and 121' either directly by a rectifier 3 or indirect through a thyristor 22, 23.

The operating principle of the apparatus resides in the fact that two adjacent portions 111 and 121 or 111' and 121' of rails 11 and 12 in contact with slides 41, 42 of a carriage 4 are always supplied by the same rectifier 3.

However, it is easy to deduce from the above description an apparatus which comprises carriages 4 carrying a single contact slide 41 mounted on a rail 11 (as described previously) with the supply device differing from the preceding one only by the absence of the bridgings 14.

An example of the operation of the second embodiment during the passage of a carriage from one portion 111 to the next portion 111 will now be described. A carriage 4 passing through a portion 111 is directly supplied by a rectifier 3. When carriage 4 reaches a dividing zone 151, the voltage of rectifier 3 is increased so that its voltage is higher than that of the rectifier connected to thyristor 22 of portion 111' located at the end opposite said portion 111' compared with portion 111. This command makes it possible to make thyristor 23 conductive and to block the preceding thyristor 22 so that current on both sides of the dividing zone 151 rail 11 is supplied by the same rectifier 3. Thyristors 22 and 23 continuously receive pulses to be started (actually this arrangement makes it possible, during a possible false contact between a slide 41, 42 and a rail portion 111', 121' or in the circuit switching off the thyristor concerned, that the latter is immediately restarted). When carriage 4 has entered into portion 111' an increase in the voltage of rectifier 3 connected to thyristor 22 compared with the voltage of the previously used rectifier makes thyristor 22 conductive by transmitting starting pulses to it, portion 111' then being supplied by rectifier 3 connected to thyristor 22. Passing by the following dividing zone 151 is performed automatically since the following portion 111 is already directly connected to the same rectifier 3.

It is possible in both embodiments at any moment to change the voltage of each rectifier 3 to modulate the polarization of body 5 as a function of its advance in tank 1 without unnecessarily shutting off current to any one body 5 at any time.

These various instructions can be created by a suitable management system, such as a manual operator or a computer. The characteristics of bodies 5 to be painted such as the size can be detected by, for example, body tracking such as photoelectric cells or detectors.

The present invention is not limited to the above-described embodiments. Obviously, numerous modifications and variations of the present invention are possible in light of the above teachings. For example, the polarities of the tank 1 and the bodies 5 may be reversed. It is therefore to be understood that within the scope of the appended claims, the invention may be practiced otherwise than as specifically described herein.

What is claimed as new and desired to be secured by Letters Patent of the United States is:

1. An apparatus for surface treatment by cataphoresis of metal parts, comprising:

a tank providing an area for the treatment of metal parts by cataphoresis;

an anode;

a pair of rails including a first rail and a second rail each being divided into a plurality of divided rails by an electrical insulating material, each of said divided rails connected to cathodes;

a carriage having a first contact slide slidably engaged with said first rail and a second contact slide slidably engaged with said second rail;

said carriage being electrically attached to one of said metal parts;

said carriage conveyed along said rails as said metal parts pass through said tank; and said carriage always contacting at least one of said divided rails for creating a potential between said one metal part, acting as said cathode, and said anode, causing the cataphoresis treatment of said metal parts without coating defects.

2. The apparatus according to claim 1, wherein:

said divided rails of said first rail are offset in relation to said divided rails of said second rail in a direction along said rails; and said electrical insulating material between each of said divided rails has a length greater than both a length of the first contact slide and a length of the second contact slide.

3. The apparatus according to claim 2, further comprising:

rectifiers supplying current to the apparatus and having negative terminals selectively connected to said divided rails, each of said divided rails selectively connected to one of said negative terminals, and having positive terminals connected to said anodes of said tank.

4. The apparatus according to claim 3, further comprising:

diodes having anodes connected to ground and to said tank and having cathodes connected to said negative terminals of said rectifiers for avoiding corrosion.

5. The apparatus according to claim 3, wherein:

a number of said rectifiers is equal to a number of said metal parts simultaneously present in the tank.

6. The apparatus according to claim 2, wherein:

the electrically insulating material between each of said divided rails constitute dividing zones, said dividing zones of a same said rail are spaced apart by spacing $\lambda$, and a linear offsetting between the dividing zones located on adjacent rails is equal to $\lambda/2$.

7. The apparatus according to claim 6, wherein the dividing zones, which have a length greater than that of said first and second contact slides, also have a length less than $\lambda/4$.

8. The apparatus according to claim 3, further comprising:

thyristors allocated in a number of groups equal to a number of said divided rails, each group including a number of said thyristors equal to a number of said rectifiers;

anodes of thyristors of each group of said groups electrically connecting together and electrically connecting to a different divided rail of said divided rails;

cathodes of each group of said groups connecting to different negative terminals of said rectifiers; and wherein, the thyristors connected to divided rails, which are in contact with the first contact slide and the second contact slide, are switched to a common rectifier of said rectifiers to prevent sparking.

9. The apparatus according to claim 8, wherein:

the thyristors of same said groups are physically grouped together and located adjacent the rails to avoid sparks caused by inductive charge build up in lengthy electrical connections.

10. The apparatus according to claim 1, wherein:

said rails are regularly divided at an interval approximately equal to $\lambda/2$ into said divided rails each separated by an said insulating material, said divided rails of said first rail and said second rail are aligned along a direction of said rails; and said electrical insulating material between each said divided rail having a length less than both the length of said first contact slide and the length of said second contact slide.

11. The apparatus according to claim 10, further comprising:

rectifiers supplying power to the apparatus and having negative terminals connected to different divided rails; and diodes having anodes connected to the ground of the tank and having cathodes connected to said negative terminals of said rectifiers.

12. The apparatus according claim 11, wherein a number of said rectifiers is equal to a number of said metal parts simultaneously present in the tank.

13. The apparatus according to claim 11, further comprising:

thyristors having cathodes connected to negative terminals of said rectifiers and having anodes connected to every other said divided rail along each of said rails; and a remainder of said divided rails being supplied current directly from said negative terminals of said rectifiers.

14. The apparatus according to claim 13, wherein:

the thyristors are physically located adjacent corresponding said divided rails, and said rectifiers are physically located adjacent corresponding said divided rails for preventing sparks caused by inductive charge build up in lengthy electrical connections.

15. The apparatus according to claim 10, wherein the carriage further comprises:

swing trays which support the metal parts.

16. The apparatus according to claim 15, wherein the electrical insulating material between each of said dividing rails constitute dividing zones aligned directly opposite each other along said rails.

17. The apparatus according claim 16, further comprising:

a supply wire electrically connecting said divided rails of said first rail to adjacent said divided rails of said second rail, for bridging said divided rails between the rails.

* * * * *